United States Patent [19]

Heinrichs

[11] 4,230,136

[45] Oct. 28, 1980

[54] DEVICE FOR COUNTING AND SORTING COINS

[76] Inventor: Friedrich Heinrichs, Steinstrasse 66, D-5090 Leverkusen 3, Fed. Rep. of Germany

[21] Appl. No.: 25,289

[22] Filed: Mar. 29, 1979

Related U.S. Application Data

[63] Continuation-in-part of Ser. No. 799,095, May 20, 1977, abandoned.

[51] Int. Cl.[3] ..... G07D 3/02

[52] U.S. Cl. ..... 133/3 E; 133/8 R

[58] Field of Search ..... 133/3 R, 3 A, 3 D, 3 E, 133/3 F, 3 H, 8 R, 1 R

[56] References Cited

U.S. PATENT DOCUMENTS

| | | | |
|---|---|---|---|
| 2,101,513 | 12/1937 | Samuelsen et al. | 133/3 E |
| 3,086,536 | 4/1963 | Klopp | 133/8 R |
| 3,848,614 | 11/1974 | Conant et al. | 133/8 R |
| 3,939,954 | 2/1976 | Collins | 133/3 R X |
| 4,167,949 | 9/1979 | Hashimoto et al. | 133/3 D |

*Primary Examiner*—Joseph J. Rolla

*Attorney, Agent, or Firm*—Friedrich Heinrichs

[57] ABSTRACT

A device is provided for counting and sorting coins of various sizes. The coins are supplied from a container for unsorted coins to a guide channel adjacent thereto for guiding the coins individually and successively. The guide channel has a continouus reference edge and a base provided with openings which correspond in size to the sizes of the types of coin. A counter detects coins in the guide channel without contact. Spring loaded levers and/or conveyor belts or the like are provided for mechanically urging the coins against the reference edge.

10 Claims, 4 Drawing Figures

DEVICE FOR COUNTING AND SORTING COINS

This is a continuation-in-part of U.S. application Ser. No. 799,095, filed May 20, 1977, now abandoned.

FIELD OF THE INVENTION

The invention relates to a device for counting and sorting coins of various sizes which has a supply container for the unsorted coins with a base, the base being, for example, in the form of a spinning disc. The coins are fed along an adjoining guide channel which has openings in the base thereof corresponding in size to the types of coin to be sorted. After passing through the openings the coins are carried individually and successively to a counter by means of endless conveyor belts.

BACKGROUND OF THE INVENTION

A device of the type set out above is known from German Offenlegungsschrift No. 2,231,088. This has two counters one behind the other in the region of the guide channel, which detect the individual coins as they pass by means of feeling elements actuated by the coins. The first counter counts all of the coins, whereas the second counter only counts the coins of the larger type because the coins of the smaller type fall through the openings in the base of the guide channel before they reach the second counter. In order to determine the monetary value of the counted coins, a subtraction operation must be performed on the two counter readings. The two counters are only sufficient for counting two types of coin. It is necessary for each other type of coin to be counted to have its own counter and in practice this device is not very suitable for counting more than two types of coin. It is complicated if a larger number of different coins are to be counted, and the interpretation of the counter readings of the individual counters becomes more and more complicated as the number of counters increases.

Another disadvantage of this known counter, which operates purely mechanically, is that erroneous counts cannot be prevented if the forward feed for the coins in the guide channel is reversed for some reason during the counting process, since, in this case, coins which have already been detected by one counter are fed past this counter again and thus detected again. This problem is particularly significant when the counters used are equipped with a simple length detector.

OBJECT OF THE INVENTION

The object of the invention is to create a device for counting and sorting coins of different sizes which detects and counts the individual passing coins without contact by means of a single counter, and the resultant count can be correspondingly read immediately and reliably from a single indicator.

SUMMARY OF THE INVENTION

According to the invention there is provided a device for counting and sorting coins of various sizes, comprising a supply container for unsorted coins; a guide channel adjacent thereto for guiding the coins therefrom individually and successively, the guide channel being provided with a continuous reference edge and having a base provided with openings which correspond in size to the size of the types of coin; a counter for detecting coins in the guide channel without contact; and means for mechanically urging the coins against the said reference edge.

All of the coins, regardless of their size, are pushed forward along a line defined by the continuous reference edge of the guide channel and are positively pressed against this reference edge in the region of the counter by means of the mechanical pressing device, in order to ensure that the individual coins lie against the continuous reference edge during counting. The counter is such as to detect the coins without contact, i.e. the counter does not have to move the coins forward, nor is it triggered by mechanical contact with the coins, as this could lead to erroneous counts.

The pressing device may be in the form of an adjustable lever, spring biassed towards the reference edge in the region of the counter. This device can be of simple design and operate reliably with a wide variety of sizes of coin. The end of the lever which acts upon the coins may be provided with a roller, such as a roller bearing. However, the coins may also be pressed against the reference edge by having a conveyor belt acting on the upper face of the coins in the region of the whole guide channel, which belt runs at an acute angle to the reference edge. The conveyor belt thus exerts not only a forward force on the coins, but also, to a lesser degree a force pressing the coins against the reference edge. This not only ensures that the coins lie against the reference edge in the region of the counter but also in the region of the openings in the base of the guide channel, so that the counted coins then also fall out of the guide channel through the respective correct opening.

The counter may be a light barrier means having an electronic counter. The light barrier means has a number of individual light barriers corresponding in number to the different types of coin to be counted. Each barrier has a respective light source and receiving element. In addition a reference barrier is provided which has its own light source and its own receiving element. The reference barrier responds to each of the coins passing the counter and causes the counting process to be triggered only when this reference barrier is interrupted by a coin. Depending upon the number of other light barriers which are also interrupted when the reference barrier is interrupted, corresponding counting pulses are introduced into the counter, and these are immediately converted into a reading, preferably a digital reading. The reference barrier in this case is arranged in the vicinity of the reference edge so that each free space between consecutive coins is detected by it, even if relatively small coins are being counted, while the light barriers carrying out the actual count cooperate with the opposite edges of the coins which pass at different distances from the reference edge depending upon the type of coin so that the position of the light barriers making the count is determined by this.

By arranging individual light emitting diodes and phototransistors of the light barriers on the arms of a C-shaped member, the counter may be easily installed without individual elements of the light barrier being movable with respect to each other in an undesirable manner. To achieve this the C-shaped member must possess sufficient rigidity and this may be effected without difficulty. Since the C-shaped member is open towards the reference edge, it may be adjusted very simply into the correct position when assembling the device and may be subsequently adjusted if necessary.

The preferred embodiment of the invention is capable of counting a large number of coins of various types reliably, because, according to a feature thereof, the first evaluating light barrier, which detects even the smallest coins, is so located and is connected to such an electronic circuit that a multiple count of the individual coins is prevented by fluttering of the coins in the plane of transport. The forward drive is preferably provided with a stop to prevent reverse movement, so that relatively large reverse movements of the coins in the guide channel cannot occur.

DESCRIPTION OF PREFERRED EMBODIMENT

Figure 1:
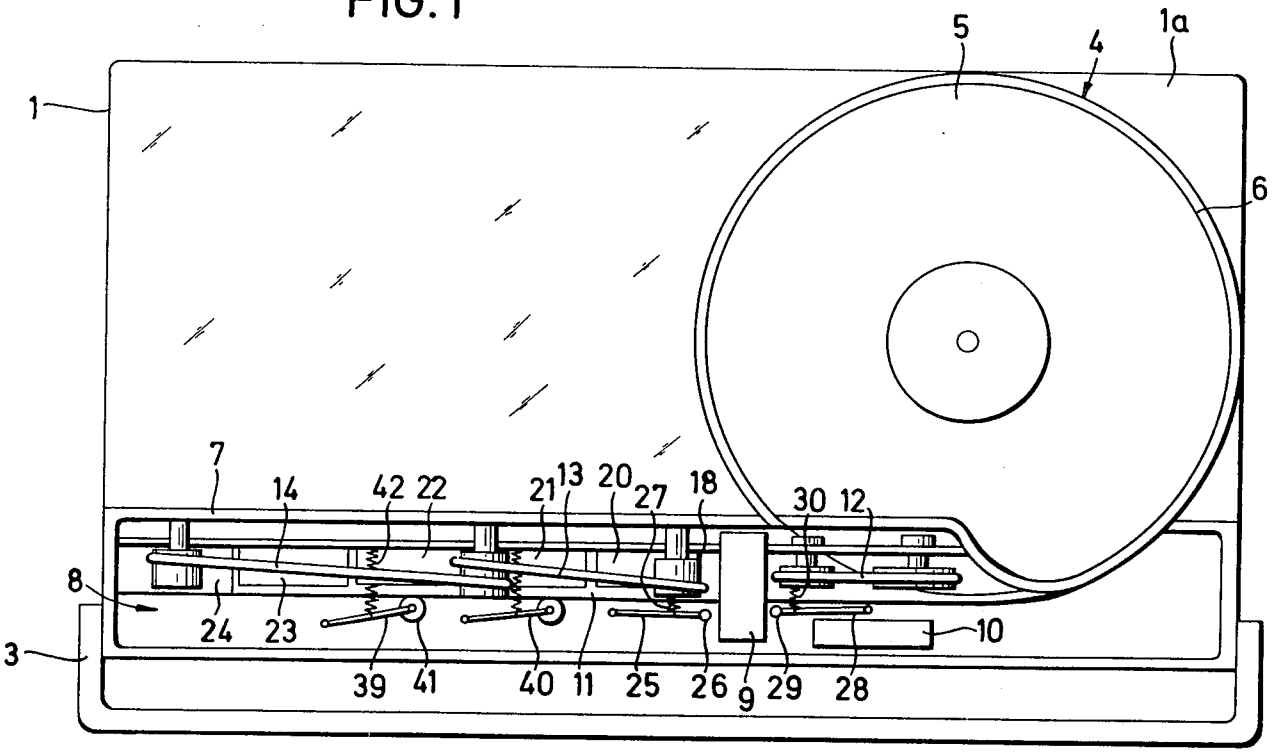
FIG. 1 is a plan view of an embodiment of the invention.

The device shown in the drawings for counting and sorting coins has a portable box-like housing 1, the upper side 1*a* of which is closed. A crank not shown, is provided on the side of the housing 1 as a drive element which may be folded into the housing when not required. Another type of drive could be used instead, such as a motor. The housing 1 is also provided with a pivotal carrying handle 3.

A substantially cylindrical supply container 4 is mounted in the upper region of the housing 1, into which container unsorted coins to be counted are poured. The base of the supply container 4 is the form of a rotatable disc 5 which may be rotated by means of the crank 2 via a transmission mechanism (not shown in the drawing) arranged beneath the crank 2, so that the coins lying on the disc are spun on to an elevated, stationary wall 6 of the supply container 4.

Figure 2:
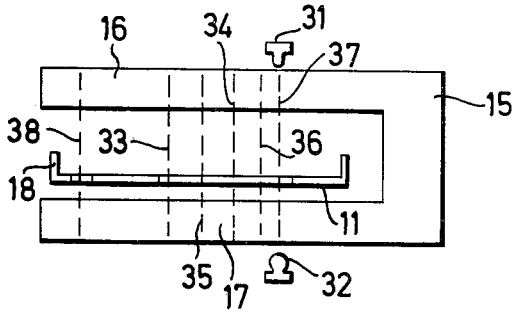
FIG. 2 shows a C-shaped member carrying a light barrier of a counter forming part of the device.

The side wall 6 of the supply container 4 is grooved in one position and, in this case, runs parallel to an elevated wall 7 which forms a side wall of a box-like top attachment 8 which contains the counter itself and is normally covered by a lid (not shown). The counting and sorting mechanism is mounted in the attachment 8. The counting mechanism comprises a counter 9 having an illuminated digital read-out 10 connected electronically thereto. A guide channel 11 with opposing conveyor belts 12, 13 and 14 is provided to carry out sorting. The counter, which is shown in detail in FIGS. 2 and 3, includes a stationary C-shaped member 15 whose arms 16 and 17 lie respectively above and below the guide channel 11. The open end of the member 15 is situated in the region of a continuous reference edge 18 of the guide channel 11, along which the individual coins 19 from the supply container 4 are pushed to individual openings 20 to 24 in the base of the guide channel 11. The openings 20 to 24 are of different sizes and widths which are determined by the diameter of the type coin which is to pass therethrough so that the coins detected by the counter 9 are sorted and fall into individual containers situated below the openings 20 to 24.

The three conveyor belts 12, 13 and 14 are arranged to run towards the reference edge 18 at a small angle and, therefore exert not only a forward drive on the coins 19 in the guide channel 11 but also a pressure directed on to the reference edge 18.

A lever 25 is pivotally mounted on the side of the guide channel 11 opposite the reference edge 18 downstream of the counter 9. The lever 25 carries a roller 26 on its free end and is urged towards the reference edge 18 by a tension spring 27. A similar lever 28 with a roller 29 on the free end is mounted upstream of the counter 9 and is used towards the reference edge 18 by means of a tension spring 30. The tension springs 27 and 30 must be strong enough for the levers 25 and 28 to even push the smallest coins 19 to be counted against the reference edge, as this is necessary for a reliable count, since the conveyor belts 12 and 13 do not act continuously on the coins 19 pushed forward in the guide channel 11 in the region of the counter 9 and in particular in the member 15 of the counter 9.

The arm 16 of the member 15 contains a number of phototransistors 31, and a respective light emitting diode (LED) 32 is positioned in the arm 17 opposite each phototransistor 31 to form a detector. The LED 32 throws a ray of light through a corresponding opening in the base of the guide channel 11 in the direction of the opposite phototransistor. If the ray of light at any time is interrupted by a coin 19 being moved forward on the guide channel 11, corresponding counting pulses are triggered in an electronic circuit (not shown) which become visible as numbers in the read-out 10.

Figure 3:
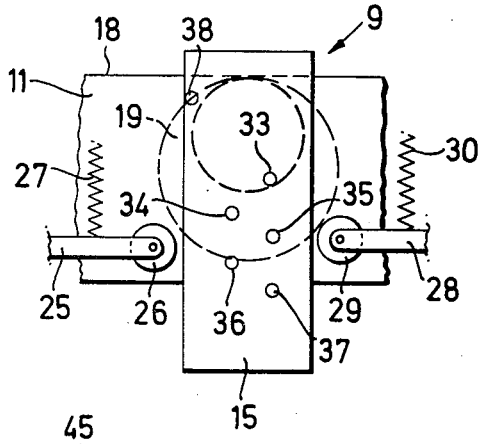
FIG. 3 is a plan view of the components shown in FIG. 2.

FIG. 3 shows a diode matrix forming the measurement recorder of the counter 9 which comprises a total of five detectors 33 to 37 which lie at different distances from the reference edge 18 so that one or more of them are covered by a passing coin 19.

Another comparison detector 38 is provided close to the reference edge 18 which serves to indicate the position of the individual coins 19 in the counter 9. A count is only triggered when the comparison 38 is interrupted by a coin 19. Since in the present case five types of coins of different sizes may be counted and sorted, five detectors 33 to 37 are provided, in addition to the comparison detector 38, from which the counting pulses corresponding to the coins are triggered. The detectors 33 to 37 are arranged next to each other and one behind the other in such a way that they are interrupted or remain uninterrupted depending on the size of the coin passing through at any time.

The device according to the invention is capable of counting coins of a wide variety of sizes without contact by means of a counter, providing a digital read-out of the counted values and sorting the coins after counting so that they fall into separate containers. Driven components of the device may be driven by the manual crank or any other common drive. The drives to the belts 12, 13 and 14 may be provided with a reverse stop to prevent the coins from reversing in the guide channel 11 and thus causing erroneous counts.

Two levers 39 and 40 are pivoted adjacent the guide channel 11 in the region of the belts 13 and 14. Each of these levers has a roller 41 on its free end and is urged towards the reference edge 18 by a spring 42. The levers 25, 28, 39 and 40 are so positioned and arranged that their rollers 26, 29 and 41 come into contact even with the smallest coin 19 transported through the guide channel 11 to press it against the reference edge 18.

Figure 4:
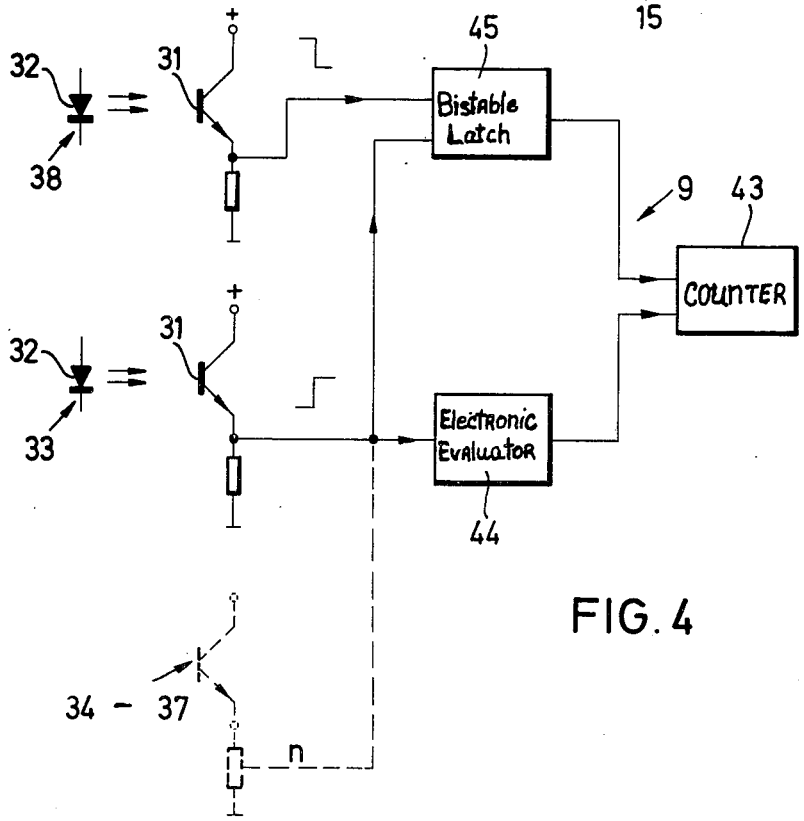
FIG. 4 is a circuit diagram of the counter.

The circuit diagram of FIG. 4 shows the electronic circuit connected to the detectors 33 to 38. This circuit contains an adder or counter 43 into which the pulses coming from the detectors 33 to 37 are fed via an evaluating electronic device 44 and the pulses coming from the detector 38 are fed via a bistable latch 45. The electronic evaluator 44 is conventional and contains appropriate electronic circuitry which determines the individual impulses from the photo-detectors 33 to 37 and sends the appropriate signal, depending upon which detector or detectors are being activated to the counter, so that the appropriate sized coin passing the device 15 is read and recorded by the counter 43. Such circuitry may be derived from U.S. Pat. No. 3,848,614 and U.S. Pat. No. 3,699,981, for reading the signals coming from detectors 33 to 37. The bistable latch 45 is switched on by the detector 38 as soon as the latter detects a coin 19 and is reset by the detector 33 as soon as this detects the same coin 19. Counting only takes place when the bistable latch 45 is set.

The distance between the detector 38 and the first of the detectors 33 to 37 and in particular the distance projected on to the reference edge 18 between these detectors can be determined geometrically and optimized mathematically.

I claim:

1. A device for counting and sorting coins of various sizes, comprising a supply container for unsorted coins; said supply container having a base in the form of a rotatable disc; a guide channel adjacent said supply container for guiding the coins therefrom individually and successively; said guide channel being provided with a continuous reference edge and having a base provided with openings which correspond in size to the size of the types of coin; a counter for detecting coins in the guide channel without contact; at least one lever mounted for pivotal movement about an axis running perpendicular to the direction of travel of the coins in the guide channel; and the said lever having a free end which is urged toward the reference edge by a spring.

2. A device according to claim 1, wherein the said free end carries a roller.

3. A device according to claim 1, comprising at least one conveyor belt adapted to act on the upper faces of coins in the guide channel, the rear end of the conveyor belt lying closer to the said reference edge than the front end thereof.

4. A device according to claim 1, wherein the counter comprises light barrier means operably connected to an electronic counting device.

5. A device according to claim 4, wherein the light barrier means comprises a plurality of individual light barriers corresponding to the different types of coin to be counted and a further light barrier for detecting all coins.

6. A device according to claim 5, wherein each light barrier comprises a light emitting diode and a phototransistor positioned to receive light from the light emitting diode, the said guide channel being situated between the light emitting diodes and the phototransistors.

7. A device according to claim 6, wherein the light emitting diode and phototransistor of each light barrier are arranged on opposite arms of a C-shaped member, one arm of the said member lying below the guide channel and the other arm lying above the guide channel.

8. A device according to claim 7, wherein the C-shaped member is open towards the reference edge of the guide channel.

9. A device according to claim 7, wherein the individual light barriers are arranged at variousdistances from the said reference edge and are located one behind another on the arms of the C-shaped member.

10. A device for counting and sorting coins of various sizes, comprising a supply container for unsorted coins; a guide channel adjacent thereto for guiding the coins therefrom individually and successively; the guide channel being provided with a continuous reference edge and having a base provided with openings which correspond in size to the size of the types of coins; a counter for detecting coins in the guide channel without contact; said counter including light barrier means operably connected to an electronic counting device; said light barrier means comprising a plurality of individual light barriers corresponding to the different types of coin to be counted and a further light barrier for detecting all coins; an electronic circuit connected to the light barriers, which circuit comprises a common counter, an evaluating electronic device for the evaluating signals from the light barriers, and a bistable latch which is adapted to be set by a signal from the said further light barrier and reset by a signal from at least one of the other light barriers; and means mechanically urging the coins against said reference edge.

* * * * *